US005516573A

United States Patent [19]

George et al.

[11] Patent Number: 5,516,573

[45] Date of Patent: May 14, 1996

[54] ROOFING MATERIALS HAVING A THERMOPLASTIC ADHESIVE INTERGACE BETWEEN COATING ASPHALT AND ROFFING GRANULES

[75] Inventors: Billy L. George; Stefan A. Babirad, both of Hudson, both of Wis.; Vincent J. Laraia, Jr., Woodbury; Wilson S. Bigham, Cottage Grove, both of Minn.

[73] Assignee: Minnesota Mining and Manufacturing Company, Saint Paul, Minn.

[21] Appl. No.: 312,464

[22] Filed: Sep. 26, 1994

Related U.S. Application Data

[62] Division of Ser. No. 934,429, Aug. 24, 1992, Pat. No. 5,380,552.

[51] Int. Cl.[6] ..... D06N 5/00

[52] U.S. Cl. ..... 428/143; 428/145; 428/150; 428/291; 428/489; 428/490

[58] Field of Search ..... 428/143, 149, 428/150, 291, 489, 490, 141, 144, 145; 524/68, 71; 427/186

[56] References Cited

U.S. PATENT DOCUMENTS

| | | | |
|---|---|---|---|
| 1,154,334 | 9/1915 | Overbury . | |
| 2,798,822 | 7/1957 | Carter | 117/30 |
| 2,909,443 | 10/1959 | Wolinski | 117/16 |
| 3,197,355 | 7/1965 | Copeland | 161/73 |
| 3,552,988 | 1/1971 | Boiardi | 117/27 |
| 3,737,511 | 6/1973 | Dillon | 264/256 |
| 3,752,696 | 8/1973 | Beyard et al. | 117/100 D |
| 3,868,263 | 2/1975 | McConnaughay | 106/281 |
| 3,869,417 | 3/1975 | Ramsay | 260/28.5 AS |
| 3,937,640 | 2/1976 | Tajima et al. | 156/71 |
| 4,055,453 | 10/1977 | Tajima et al. | 156/279 |
| 4,293,597 | 10/1981 | Bessmer et al. | 427/186 |
| 4,352,837 | 10/1982 | Kopenhaver | 427/187 |
| 4,360,473 | 11/1982 | Marzocchi et al. | 260/429.5 |
| 4,378,040 | 3/1983 | Howell | 152/213 A |
| 4,440,816 | 4/1984 | Uffner | 428/40 |
| 4,460,635 | 7/1984 | Jones et al. | 428/142 |
| 4,467,007 | 8/1984 | Elgie | 428/142 |
| 4,470,237 | 9/1984 | Lincoln et al. | 52/420 |
| 4,485,201 | 11/1984 | Davis | 524/68 |
| 4,491,608 | 1/1985 | Thygesen | 427/186 |
| 4,528,226 | 7/1985 | Sweeny | 428/40 |
| 4,581,090 | 4/1986 | Snyder | 156/279 |
| 4,659,759 | 4/1987 | Jevanoff et al. | 524/68 |
| 4,693,911 | 9/1987 | Moreau | 427/196 |
| 4,693,923 | 9/1987 | McGroarty et al. | 428/148 |

(List continued on next page.)

FOREIGN PATENT DOCUMENTS

| | | | |
|---|---|---|---|
| 2506723A1 | 8/1975 | Germany . | |
| 55-161853 | 12/1980 | Japan . | |
| 923644 | 4/1963 | United Kingdom | 427/186 |

OTHER PUBLICATIONS

*Asphalt Shingles and Roll Roofing*, Chapter 2, pp. 2–9 (undated).

*Cavalcade of Hot Melts–Their Future, Their Problems.* Course Notes from Hilton Head Island; Apr. 18–21, 1977; Technical Association of the Pulp and Paper Industry (TAPPI); 6 pages.

William C. Wake, *Adhesion and the Formulation of Adhesives*, Applied Science Publishers Limited, London, 1976, 6 pages. No Month Available.

*Primary Examiner*—Terry J. Owens

*Attorney, Agent, or Firm*—Gary L. Griswold; Walter N. Kirn; Mark W. Binder

[57] ABSTRACT

An asphalt-based roofing product includes an asphalt-based substrate such as asphalt-saturated fiberglass or cellulose felt, a non-asphalt, thermoplastic, water-resistant adhesive on the surface of the asphalt-based substrate, and a plurality of roofing granules embedded in the asphalt such that the adhesive provides an interface between the asphalt and roofing granules. The adhesive is present in an amount sufficient to improve the adhesion of the roofing granules to the asphalt.

8 Claims, 2 Drawing Sheets

U.S. PATENT DOCUMENTS

| | | | |
|---|---|---|---|
| 4,714,629 | 12/1987 | Davis et al. | 427/138 |
| 4,714,651 | 12/1987 | Hartmann et al. | 428/286 |
| 4,791,022 | 12/1988 | Graham | 428/324 |
| 4,835,199 | 5/1989 | Futamura et al. | 524/66 |
| 4,850,304 | 7/1989 | Nicholson | 118/694 |
| 4,871,586 | 10/1989 | Toncelli | 427/204 |
| 4,871,605 | 10/1989 | Pagen et al. | 428/141 |
| 4,873,275 | 10/1989 | Moran et al. | 524/64 |
| 4,883,703 | 11/1989 | Riccio et al. | 428/142 |
| 4,895,754 | 1/1990 | Graham et al. | 428/289 |
| 4,992,315 | 2/1991 | Zickell et al. | 428/41 |
| 4,997,717 | 3/1991 | Rembold et al. | 478/413 |
| 5,089,052 | 2/1992 | Ludwig | 106/276 |
| 5,090,154 | 2/1992 | Jacob | 47/9 |
| 5,100,715 | 3/1992 | Zimmerman et al. | 428/147 |
| 5,102,728 | 4/1992 | Gay et al. | 428/268 |
| 5,110,627 | 5/1992 | Shoesmith et al. | 427/208.4 |
| 5,112,678 | 5/1992 | Gay et al. | 428/268 |
| 5,124,177 | 6/1992 | Kasmark, Jr. et al. | 427/202 |
| 5,206,068 | 4/1993 | Kalkanoglu | 428/143 |

ROOFING MATERIALS HAVING A THERMOPLASTIC ADHESIVE INTERGACE BETWEEN COATING ASPHALT AND ROFFING GRANULES

This is a division of application Ser. No. 07/934,429, filed Aug. 24, 1992, now U.S. Pat. No. 5,380,552.

FIELD OF THE INVENTION

The present invention relates to asphalt roofing systems and products, such as asphalt roofing shingles. The invention particularly concerns such systems and products which include roofing granules embedded therein. According to the present invention there is provided an improvement in the binding of the roofing granules to the asphalt roofing product.

BACKGROUND OF THE INVENTION

Asphalt-based roofing systems and products are well known. They include, for example, asphalt shingles and asphalt roll roofing. Many conventional materials are utilized as raw materials in the manufacture of asphalt roofing systems and products.

Asphalt roofing systems and products generally comprise a substrate which is filled and coated with various asphalt materials. Generally, the substrate is filled with a "saturant" asphalt. A saturant asphalt is oil-rich and relatively nonviscous, to provide maximum waterproofing and saturation of the substrate. The saturant asphalt serves as a preservative, a waterproofing agent and an adhesive agent.

The saturated substrate is sealed by application of a harder, more viscous "coating" asphalt to both sides of the substrate. Coating asphalts generally contain finely divided minerals therein as stabilizers or fillers. Such compounds as silica, slate dust, talc, micaceous materials and dolomite have been utilized as fillers to render the coating asphalt more shatter-proof and shock-proof in cold weather.

The exterior, outer, or exposed surface of asphalt roofing systems and products is generally provided with a covering of granular material or roofing granules embedded within the coating asphalt. The granular material generally protects the underlying asphalt coating from damage due to exposure to light, in particular ultraviolet (UV) light. That is, the granules reflect light and protect the asphalt from deterioration by photodegradation. In addition, such granular material improves fire resistance and weathering characteristics. Further, colors or mixtures of colors of granular material may be selected for aesthetics.

In general, the mineral materials, particles or granules are embedded within the coating asphalt under pressure and are retained therein by adherence to the asphalt. With respect to each granule, the asphalt may be viewed as a "hot sticky mud" into which the granules are pressed. When the asphalt cools, pockets having the granules retained therein are formed.

Good adherence of the roofing granules to the roofing product is beneficial. Loss of granules reduces the life of the roof, since it is associated with acceleration of photodegradation of the asphalt. In addition, the aesthetics of the roofing system may be compromised if granules are lost. Further, reduction of granule loss during installation improves safety conditions on the roof.

Granule loss can also occur due to physical abrasion of the granular surface. This may occur any time a person walks on an installed roof for maintenance, during installation of the roofing surface or by such environmental conditions as tree branches rubbing on the granular surface and the physical contact of rain or hail with the roofing surface.

It has been found that adherence between the roofing granules and the coating asphalt is subject to deterioration by moisture. Granule-asphalt adhesion is not well understood. However, it is probable that secondary bonding interactions contribute to adhesive bond strength. Disruption of this secondary bonding by moisture may lead to decreased adhesion of granules to asphalt. Although water run-off from a slanted roof is generally sufficient to avoid prolonged exposure to moisture and thus to avoid substantial degradation by moisture to the granule/asphalt bond or interface, problems from moisture deterioration nevertheless pose substantial risk. For example, deterioration may be substantial in humid environments or in relatively flat portions of roofs where water can collect. Further, in many instances bundles of shingles (or similar roofing material) are stored in plastic wraps or containers prior to installation. Moisture trapped within such wraps or containers may cause substantial deterioration of the granule/asphalt bond, with resultant reduction in the integrity of the later installed roofing surface.

Prior to applicants' improvements to the adhesion of roofing granules to the roofing product, it was generally felt that granule asphalt adhesion was satisfactory. It is, however, clear from the above discussion that beneficial results may be achieved by improving the granule asphalt adhesion in roofing products. What has been needed has been a method of improving asphalt-based roofing systems having granular material embedded therein with respect to granule loss due to moisture attack compromising the granule/asphalt bond or interface. In addition, improved roofing materials with respect to photodegradation of the asphalt layer by preventing granule loss by physical abrasion have been desired.

SUMMARY OF THE INVENTION

According to the present invention there is provided a method for preparing a roofing product. The method comprises the steps of providing a hot asphalt surface in the roofing product, applying an effective amount of a non-asphalt adhesive material to the hot asphalt surface; and, embedding a plurality of roofing granules in the hot asphalt surface. The method may be utilized to prepare, for example, shingles and rolls of roofing material.

Preferably, the adhesive utilized is a non-asphalt adhesive having a viscosity sufficiently low at temperatures between 150° C. and 260° C. to facilitate spraying. More preferably, thermoplastic materials capable of forming a moisture-resistant bond are chosen as the adhesive. Most preferably, the adhesive is applied to the hot asphalt surface in thin streams and is applied to cover at least 25% and preferably about 50% to about 75% of the surface of the hot asphalt to which the roofing granules are to be applied. Even at lower levels of coverage, adhesion improvements are expected.

In typical and preferred applications, streams of adhesive on the order of about 100–200 micrometers in diameter will be useable and effective. These can be applied in a variety of means, such as for example by spraying from a gun using an orifice or orifices that ejects a stream of adhesive into a gas stream, resulting in a blown fiber spray.

It is foreseen that in typical applications, such as to produce shingles or the like, the hot asphalt surface will comprise a surface of coating asphalt applied to a roofing substrate web. A variety of roofing substrate webs may be utilized, including cellulose webs, saturated with a saturating asphalt and fiberglass webs, also provided with saturating asphalt therein.

Preferred methods according to the present invention are applied to systems wherein the asphalt includes fillers therein, for example for fire proofing.

A variety of materials may be applied as the roofing granules. Preferred roofing granules comprise a ceramic-coated colored mineral aggregate, such as 3M brand Roofing Granules available from Minnesota Mining and Manufacturing Company of St. Paul, Minn.

Preferred materials utilized as the non-asphalt adhesive comprise hot melt adhesive selected from the group consisting essentially of blends of thermoplastic polymers and tackifying resins, such as resins of aromatic modified hydrocarbons.

The invention includes within its scope products made according to the preferred processes described herein above.

Also according to the present invention there are provided roofing products comprising asphalt having roofing granules embedded therein; a non-asphalt adhesive being provided at the interface between the granules and the asphalt. The adhesive roofing granules and asphalt may be as generally described above.

In general, in products and processes according to the present invention, an "effective amount" of adhesive is the amount to be applied. By the term "effective amount" in this and similar context herein, it is meant that an amount of adhesive should be utilized to improve the performance of the resulting product; i.e., to provide greater adherence of the granules within the asphalt than is achieved in the absence of the adhesive. Improvements may be measured with respect to either wet or dry tests, as described herein. In general an improvement in adherence with respect to either test is considered an improvement, and thus an amount of adhesive which will provide such an improvement is an effective amount of the adhesive. It is a particular advantage of products and processes according to the invention that they provide improvement with respect to conventional systems in performance under wet or humid conditions.

The bonding or adhesion of roofing granules to the asphalt is not well understood. Since asphalt includes properties characteristic of and may be considered a hot-melt adhesive, there is no reason to predict that the addition of a non-asphalt adhesive, and more particularly a hot-melt adhesive such as having a thermoplastic polymer as a blend with tackifying resins, would produce such improved adhesion between the roofing granules and coating asphalt. Furthermore, application of the thermoplastic polymers blended with tackifying resins by using a spraying gun ejecting a stream of adhesive into a gas stream, resulting in a blown fiber spray onto a hot asphalt surface was believed unknown. This method of application advantageously minimizes the quantity of additional non-asphalt adhesive to be effective because the adhesive is applied directly to the hot asphalt surface and gives an even distribution of the adhesive over the hot asphalt surface. As detailed in experimental results disclosed herein, the improvement in asphalt roofing granule adhesion is dramatic. In dry rub tests, the use of an adhesive reduced roofing granule loss by at least two-fold. In wet rub tests, with a preferred adhesive 3M #3755 as described below, wet rub loss of roofing granules was reduced by a factor of greater than 300 times in a 1-day wet rub test, and by a factor of six times in a 7-day wet rub test.

The drawings constitute part of the specification and include exemplary embodiments of the present invention. In the drawings, relative material thicknesses and component sizes may be shown exaggerated, to facilitate understanding.

DETAILED DESCRIPTION OF THE INVENTION

Figure 1:
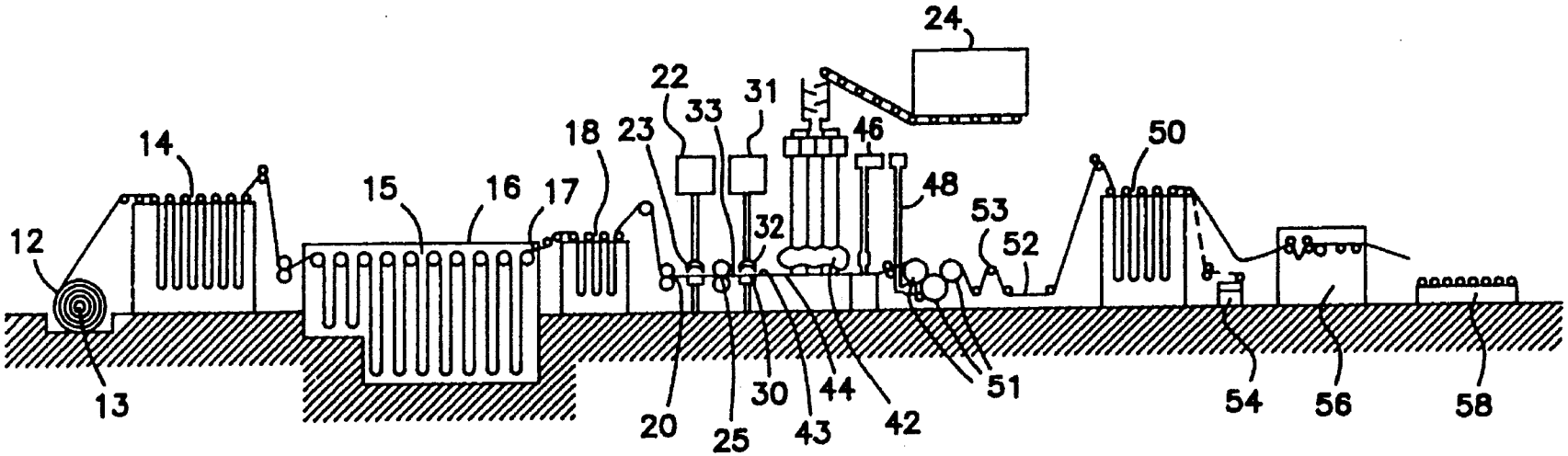
FIG. 1 is a schematic diagram depicting an overall process embodying a method of manufacturing roofing products according to the present invention.

In general, according to the present invention, asphalt-based roofing materials having granules embedded therein are improved with respect to resistance (of the adherence of the granules within the asphalt) to moisture deterioration through the provision of an adhesive within the roofing materials to facilitate retention of the granules to the asphalt. The provision of the adhesive can also improve granule retention during conditions of physical abrasion, irrespective of moisture deterioration.

Improved granule retention increases the useful life of the roofing system by inhibiting exposure of the asphalt layer to ultraviolet light and thus inhibiting photodegradation of the coating asphalt. In preferred applications, the adhesive comprises a hot-melt adhesive applied to the coating asphalt before the granular mineral material is applied thereon. Preferred materials for use in preparing products according to the present invention are described hereinbelow. In addition, descriptions of a preferred method of preparing roofing products and preferred roofing products are provided.

THE RAW MATERIALS

Except for the adhesive, described below, raw materials utilizable for providing improved roofing systems and products according to the present invention may, in general, be conventional materials utilized for roofing.

1. The Substrate

A variety of materials may be utilized as the substrate for the roofing materials. In general, preferred materials comprise a non-woven matting of either fiberglass or cellulose fibers. Fiberglass matting is used most widely in the asphalt roofing products industry and is a typical and preferred substrate for use with methods and in products according to the present invention. Cellulose matting, sometimes referred to as organic matting or rag felt may also be utilized.

Fiberglass matting is commercially available from Owens-Corning Fiberglass Corporation, Toledo, Ohio and Manville Roofing Systems, Denver, Colo. These commercially-available substrates are utilized in preferred embodiments of the present invention. It is recognized that any fiberglass mat with similar physical properties could be incorporated into the process of the present invention with satisfactory results. Generally, the fiberglass matting is manufactured from a silicate glass fiber blown in a non-woven pattern in streams of about 30–200 micrometers in diameter with the resultant mat approximately 1–5 millimeters in thickness.

Cellulose felt (dry felt) is typically made from various combinations of rag, wood and other cellulose fibers or cellulose-containing fibers blended in appropriate proportions to provide the desirable strength, absorption capacity and flexibility.

2. The Asphalt

Roofing asphalt, sometimes termed "asphalt flux" is a petroleum based fluid comprising a mixture of bituminous materials. In the manufacture of roofing it is generally desirable to soak the absorbent felt or fiberglass mat until it is impregnated or saturated to the greatest possible extent with a "saturant" asphalt, thus the asphalt should be appropriate for this purpose. Saturant asphalt is high in oily constituents which provide waterproofing and other preservatives. Substrates saturated with saturant asphalt are generally sealed on both sides by application of a hard or more viscous "coating asphalt" which itself is protected by the covering of mineral granules. In the case of fiberglass mat based asphalt roofing products, it is well understood that the coating asphalt can be applied directly to the unsaturated fiberglass mat.

The asphalts used for saturant asphalt and the coating asphalt are prepared by processing the asphalt flux in such a way as to modify the temperature at which it will soften. The softening point of saturant asphalt varies from about 37° C. to about 72° C., whereas the softening point of desireable coating asphalt runs as high as about 127° C. The softening temperature may be modified for application to roof systems in varying climates.

In general, conventional, commercially available, asphalt systems may be utilized in applications of the present invention.

3. Stabilizers and Fillers

A variety of stabilizers and fillers may be utilized in asphalt-based roofing systems according to the present invention. For example, silica, slate dust, talc, micaceous materials, dolomite and trap rock may be utilized as stabilizers or fillers in the coating asphalt. These compounds are utilized in conventional systems and they may be used in improved systems according to the present invention in the same manner. Such materials render the asphalt base improved with respect to shatter resistance and shock resistance (tensile strength). In addition, they provide fire protection. Also, they provide raw material cost savings and improved weathering characteristics.

4. Granular Surfacing

Roofing granules or granular surfacings used in conventional roofing systems may be applied to systems according to the present invention. In general, they comprise colored slate or rock granules either in natural form or colored by ceramic processes. Preferred such materials are generally aluminosilicate materials. They may be coated with a variety of materials, to render unique and desirable properties.

In general, any mineral material which is opaque, dense, and properly graded by screening for maximum coverage can be used conventionally and in roofing products of the present invention. Generally, these materials are crushed and graded prior to artificially coloring the roofing granules. In preferred applications, minerals are crushed and screened to the desired size, generally to pass a #12 mesh (U.S. Standard) screen and to be retained on a #40 mesh (U.S. Standard) screen. Methods to color such granules are generally disclosed by Beyard et al. in U.S. Pat. No. 3,752,696 which is incorporated herein by reference.

Suitable base granules can be selected from a wide class of relatively porous or non-porous and weather-resistant rock or mineral materials. Suitable minerals include trap rocks, slates, argillite, greystone, greenstone, quartz, quartzite, certain granites or certain synthetic granules made from clay or other ceramics. In general, the preferred base granules are derived from relatively non-porous rock.

Commercially available roofing granules useable in systems, products and methods according to the present invention include for example, the entire line of roofing granules manufactured by Minnesota Mining and Manufacturing Company of St. Paul, Minn.

5. The Adhesive

As indicated above, according to the present invention an adhesive is provided onto the coated asphalt-based substrate to facilitate retention of the granules therein. In preferred processing, adhesive is applied subsequent to application of the coating asphalt and prior to deposition of the granular material on the coating asphalt surface.

The preferred adhesives are blends of thermoplastic polymers and tackifying resins which will readily wet the rock granules or mineral materials used as surfacing materials to facilitate adhesion. A key to selection of such adhesive is based on mechanical properties relative to that of the coating asphalt. The tensile strength as measured by ASTM Standard Test D-1708 (incorporated herein by reference) gives a measure of the mechanical property of the adhesive known as the "cohesive strength". The cohesive strength of the selected adhesive should be higher than that of the coating asphalt utilized in manufacture of the roofing material in order to give the improved granular retention of the present invention. The cohesive strength is measured by the above test in preferred adhesives ranges from about 181 p.s.i. to about 2100 p.s.i., more preferably from about 300 p.s.i. to 500 p.s.i. It is also beneficial (but not necessary) for the adhesive to have sufficient ductility as measured by ASTM Standard Test D-1708, incorporated herein by reference, such that the percent elongation at failure exceeds 25%.

General rheological properties of preferred adhesives to be utilized in the present invention include adhesives which are solid at room temperature, liquify when heated, and lose heat to the substrate, to set when cooled. Further, the adhesive should have low surface tension which enables the material to wet out on both the substrate (coating asphalt) and the granules. The adhesive should also have a relatively high temperature coefficient of viscosity which is calculable from the melt viscosities measured by ASTM Standard Test D-3236 (incorporated herein by reference). Further, the adhesive should have a relatively high melt flow index as measured by ASTM Standard Test D-1238 (incorporated herein by reference, modified), so that the material is very fluid at high temperatures but rapidly sets as the temperature falls. Specifically, the melting temperature or Ring and Ball softening point of the adhesive, as measured by ASTM Standard Test E-28 (incorporated herein by reference) should be comparable to or below that of asphalt so that it flows readily at temperatures of application above about 148° C.

The adhesive material should adhere well to aluminosilicate materials (such as those used in roofing granules) as well as to the bituminous materials (such as the coating asphalt). As outlined below, applicants have utilized a screening test to determine the viability of adhesives for use in the present invention and to measure the improvement in granule adhesion.

Adhesives utilized in the present invention should preferably be thermally stable up to about 260° C. and should set upon cooling. The adhesives should also possess good resistance to ultraviolet light photodegradation and degradation by other photochemical processes.

Useable materials as (or as components of) hot-melt adhesives for applications of the present invention include: polyolefins, ethylene-vinyl acetate copolymers (EVA), ethylene-ethyl acetate copolymers, ethylene-n-butylacrylate polymers (ENBA), ethylene-methylacrylate polymers (EMA), styrene-isoprene-styrene block or graft copolymers (SIS), styrene-butadiene-styrene block or graft copolymers (SBS), other styrene-containing block or graft copolymers, polyamide terpolymers, hydrocarbon rubbers, polyesters, polyurethanes and siloxanes. It should be noted that these polymers and copolymers will seldom be used alone in applications of the present invention, rather, they will typically be used as components in polymer/resin blends, to provide an adhesive with preferred characteristics.

Preferred hot-melt adhesives (HMA) which are presently believed to give superior improvements in the granule bond to the finished roofing product include: 3M's Hot Melt Adhesive (HMA) #3755 and 3M's HMA #3756 which are ethylene-vinyl acetate copolymers blended with an aromatic modified hydrocarbon resin; 3M's HMA #3777 which is an ethylene-methylacrylate polymer blended with an aromatic modified hydrocarbon resin.

PREPARATION OF IMPROVED ROOFING SYSTEMS AND PRODUCTS

A schematic generally illustrating preparation of roofing shingles according to the present invention is illustrated in FIG. 1. Except for addition of adhesives as described, and modifications to accommodate addition of adhesives as described, the system in FIG. 1 is generally as presented in U.S. Pat. No. 4,352,837 (Kopenhaver), incorporated herein by reference.

In operation, a roll of dry felt or bonded fiberglass mat 12, (the substrate) in sheet form, is installed on a feed roll 13 and unwound onto a dry looper 14. The dry looper 14 acts as a reservoir of mat material that can be drawn upon during the manufacturing operation to inhibit stoppages which might otherwise occur when new or additional rolls are fed into the system. Dry felt, or mat 12, is subjected to a hot asphalt saturating process, indicated generally at 15, after it passes through dry looper 14. The purpose of the asphalt saturating process 15 is to eliminate moisture and to fill the intervening spaces of the fibers of the substrate 12 as completely as possible. The saturating process is conducted in a saturation tank 16 in which saturating asphalt is contained. Sufficient heat is added to maintain the saturant asphalt in saturation tank 16 as a flowable liquid, typically at application temperatures of at least about 70° C.

Following saturation tank 16, the saturated web 17 is passed through wet looper 18 whereat it is cooled and shrunk, permitting excess asphalt material to be further drawn into the substrate.

The mat 12, after saturation with saturating asphalt in tank 16, is next passed through looper 18 and is then directed into coating area 20, for uniform coating with a coating asphalt, to the top and bottom of the mat. Coating area 20 contains a material reservoir 22 and an applicator with a distributor nozzle 23, which are operated to apply the asphalt coating material to the top surface of the mat. Excess coating material flows over the sides of the substrate and into a pan (not shown) from which it is picked up by adjustable rollers 25 for application to the bottom of the web, in a uniform layer.

If, the mat 12 comprises a fiberglass mat, it is well accepted in the industry that the coating asphalt can be directly applied to an unsaturated fiberglass mat, although it may be saturated first. Thus, the above-described process can be modified by feeding the fiberglass mat 12 directly from dry looper 14 to the coating area 20.

At station 30, an adhesive reservoir 31 and applicator with distributor nozzle 32 are shown. The hot-melt adhesive is contained within adhesive reservoir 31 and is distributed to the upper surface of asphalt-coated web 33 by distributor nozzle 32.

The adhesive may be applied in a variety of patterns and manners. In general, satisfactory results are obtained if the adhesive is applied in thin streams on the order of about 100–200 micrometers in diameter, for example with a blown-fiber adhesive spray gun such as that manufactured by PAM Fastening Technology, Model PAM 500KS. The thin streams may be applied in a random pattern or in other patterns. In general, for some improvement all that is required is that an effective amount of adhesive be applied to the asphalt-coated web 33 upper surface to which granular material is eventually applied By the term "effective amount" in this context, it is meant that an amount of adhesive is applied such that with respect to loss of granular material due to moisture attack or deterioration, the resulting product is improved. In addition, in many applications such an amount of adhesive will also improve dry adhesion. Hereinbelow a "wet rub test" and a "dry rub test" are described, by which improvement can be evaluated.

Preferably the adhesive is distributed in thin streams of about 100–200 micrometers diameter until at least about 25% and more preferably 50–75% of the upper surface of asphalt-coated web 33 is covered thereby. Preferably, the adhesive is applied while the coating asphalt is still hot, i.e. on the order of at least 170° C. (340° F.).

Still referring to FIG. 1, roofing granules are contained within hopper or blender 24. They are applied to the upper surface of adhesive-coated web 43 by gravity feed through granule distributor 42. Excess granules may be picked up by a mechanism generally indicated at spill area 46. In addition, the underside 44 of web 43 may be coated with talc, mica or other suitable materials which are applied by a distributor 48.

In order to obtain proper adhesion of the granules, the sheet granules are subject to controlled pressure by compression rollers or drums 51 which force the granules into the asphaltic coating material (and adhesive) a predetermined depth. Cooling may be added to these drums or rollers to cool the hot asphalt as the granules are pressed or embedded therein.

The web with granules embedded therein, 52, then travels through tension roller area 53 which assists in feeding the web material through the previously-disclosed process. The web material 52 with the granules embedded therein, is then fed to a finished or cooling looper 50. The primary function of this looper is to cool the sheet down to a point where it can be cut and packed without danger to the material. Subsequent to the cooling looper 50, the sheet may be fed to a roll roofing winder 54. Here the sheet is wound on a mandrel which measures the length of the material as it turns. When sufficient material has accumulated it is cut off, removed from the mandrel and passed on for wrapping.

Alternatively, the sheet leaving the cooling looper 50 may be fed to a shingle cutter 56. It will be understood that the finished sheet or web may be cut to desired shapes or sizes and it may be modified, for example, by the addition of liners, application adhesives, or other modifications. The cut shapes or sizes are transferred to a stacking/packing area 58.

The type of processing described above is well-known in the manufacturing of shingles or other roof materials, for example, as described in U.S. Pat. No. 4,352,837, which is incorporated herein by reference.

Figure 2:
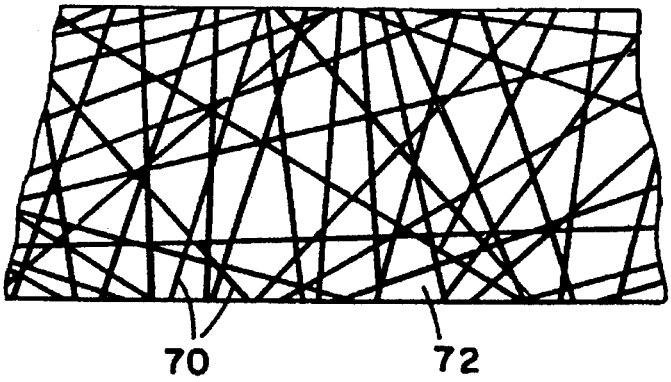
FIG. 2 is a top planar view of a substrate during a process of producing a roofing product according to the present invention.

In FIG. 2, a schematic planar depiction of the upper surface of adhesive-coated web 43 in the process of FIG. 1 is illustrated, after the application of adhesive thereto. From FIG. 2 it will be understood that the adhesive is applied in streams 70, in this instance in a random pattern, onto the asphalt-coated substrate surface 72. From FIG. 2 it can be understood that there is no requirement that the adhesive be spread evenly over the entire area of surface 72. A variety of random and regular patterns, including linear or curved patterns, circular patterns, crossing patterns, etc. may be utilized for the adhesive streams. Also, variations in the diameter of the applied adhesive streams can be made.

THE RESULTING ROOFING PRODUCT

Figure 3:
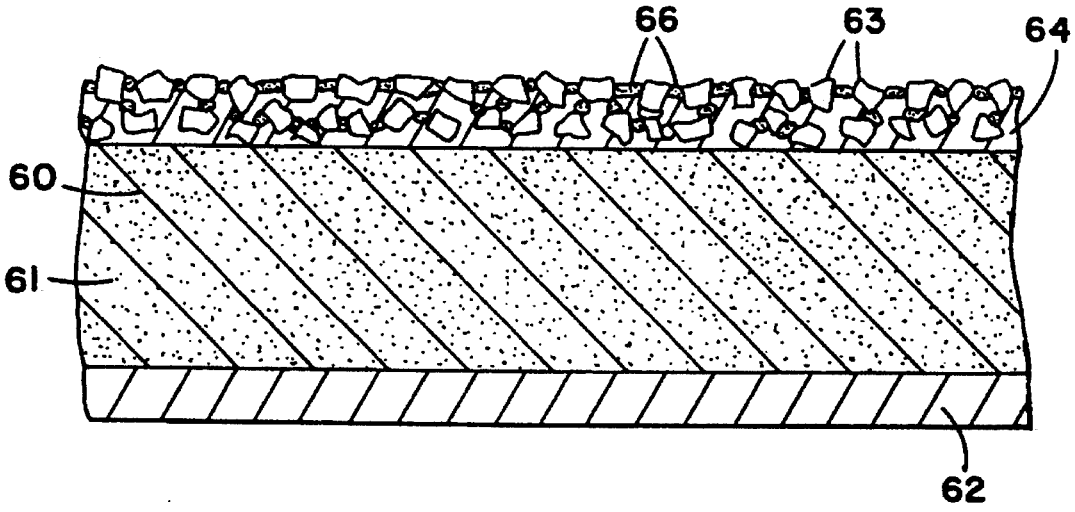
FIG. 3 is a cross-sectional view of a roofing product according to the present invention.

In FIG. 3, a cross-section of the roofing product according to the present invention is illustrated schematically. FIG. 3 is a fragmentary cross-sectional view depicting non-woven substrate 60, saturated with saturating asphalt 61 and covered with a layer of coating asphalt. Both an underside layer of coating asphalt 62 and an upper side layer of coating asphalt 64 are depicted. Mineral material granules 63 are shown embedded in the upper coating of asphalt 64 on the overall product. The granules are secured within the product by both the upper coating of asphalt 64 and applied adhesive 66.

EXPERIMENTAL

The principles and advantages of the present invention will be understood in part by reference to the following examples. In general, according to the examples, test roofing materials were prepared in which adhesive was utilized to facilitate adhesion of granular material in coating asphalt. Evaluation of the quality of the adhesion was conducted by pick tests, wet rub tests, and dry rub tests. In general, the wet rub testing illustrates the extent to which improvement, with respect to water deterioration or moisture deterioration of the adhesion, was achieved. The dry rub testing illustrates the extent to which the roofing product is improved by the provision of adhesive when the roofing product is subjected to conditions of physical abrasion (absent moisture as a contributing factor to deterioration of the granule/asphalt bond). Improvement was, in general, measured by comparison to comparative examples prepared without the adhesive present.

The wet rub test, dry rub test, pick test and adhesive screening test procedures utilized for the examples are as follows:

1. Dry Rub Test

The dry rub test is a standard test method for the determination of granular adhesion to mineral-surfaced roofing under conditions of abrasion. The procedure is described in ASTM standard D 4977–89, incorporated herein by reference. Dry rub tests conducted to evaluate granular adhesion in products according to the present invention, were conducted in compliance with this standard.

In general, a brush with 22 holes, each containing bristles made of 0.012 inch diameter tempered steel wire (40 wires per hole, set with epoxy) was used to abrade the granular surface of a specimen of mineral-surfaced roofing. The adhesion is assessed by weighing the amounts of granules that are displaced and become loose as a result of the abrasion test. The testing apparatus is a machine designed to cycle a test brush back and forth (horizontally) across a specimen at a rate of 50 cycles in a period of about 60–70 seconds while the brush assembly rests on the specimen with a downward mass of 5 pounds ±¼ ounce with a stroke link of 6±¼ inch. The testing machine used is available commercially, as the 3M Granule Embedding Test Machine and Abrasion Test Brushes, Minnesota Mining & Manufacturing, Inc., St. Paul, Minn.

A minimum of two 2-inch by 9-inch specimens were utilized for each test, and any loose granules were removed from the specimen with gentle tapping. Each specimen was then weighed and the mass was recorded. The specimen was then clamped to the test machine and the brush was placed in contact with the specimen (with activation of the machine so that the specimen was abraded 50 complete cycles, the brush traveling parallel to the long axis of the specimen). The specimen was then removed and weighed; the loss in mass then being calculated.

2. Wet Rub Test

The wet rub test is a variation of the dry rub test outlined above in which the procedure is modified to evaluate the adhesion of roofing granules on the roofing material subsequent to exposure to water. Sample specimens of roofing material, at least 2 inches by 9 inches, were first soaked in deionized water for a specified period of time, then blotted dry, followed by conducting the procedures of the dry rub test outlined above. The weight loss of granules subsequent to the brushing procedure was measured as a comparative amount of granule adhesion subsequent to water exposure.

In a typical test, nine scrub specimens were used for each rub condition to be tested. For example, nine for testing the specimen as received, nine for a 1-day soak test in which the sample was soaked for a 24-hour period, and nine for a 7-day test in which the sample was soaked for seven days in the deionized water prior to conducting the rub test.

The sample to be tested was placed in a soak tank with deionized water at a temperature of 70° F.± 2° F. (21° C.±2° C.) for the specified period of time. When the soak period has ended, a sample to be tested is removed from the soak tank and gently blotted followed by weighing and recording the initial weight. The rub test is then conducted as outlined above, followed by recording the final weight. The initial weighing and rub test followed by final weighing was conducted in a timely manner to avoid water evaporation error.

3. The Pick Test

Generally, the pick test is a practical test to predict the adhesive characteristics of roofing granules toward roofing asphalt. The test is also applicable to testing the adhesive characteristic of roofing granules toward the improved asphalt/adhesive combination roofing systems of the present invention. Granules sized to be retained on a U.S. Standard No. 14 screen are dropped into hot asphalt, or hot asphalt with adhesives thereon according to the present invention, and, when the asphalt or asphalt/adhesive with the granules is cooled, the granules are picked out of the asphalt. The granule surface which has been in contact with the asphalt is observed for the amount of asphalt or asphalt and/or adhesive adhering to the picked granule. If the surface of the granule is well-coated with the adhering material, the granule is concluded to exhibit a good dry pick test. Pick tests are predictors of granule adhesion only, and the rub tests as outlined above are more direct measures of the adhesion of the total system.

The procedure utilized in conducting pick tests is summarized below:

1. 5 grams of pick test asphalt (coating asphalt) was placed in a #2 salve can (approximate diameter is 2⅜ inch).
2. The asphalt was heated in a Despatch oven at 350° F. (177° C.) with full circulation of air for 10 minutes.
3. Not more than five salve cans were heated at one time.
4. The can with the asphalt was removed from the oven and tapped on a table top or etc. once to remove air bubbles.
5. Roofing granules were sprinkled from a height of 1 foot or more and tapped on table top three times to help embed the granules.
6. The salve cans with asphalt and granules were allowed to cool to room temperature (approximately ½ hour).
7. Granules were picked out of the asphalt on a dry basis first.
8. Only the most well-embedded granules were picked out.
9. The picked out granules were turned over and the area that pulled asphalt and/or adhesive that was originally embedded in the asphalt was estimated.
10. A wet pick test may also be conducted by soaking for 2 hours under ¼" of distilled water at room temperature and picking again.
11. Further, an 18-hour wet test may be completed by continuing the soak for an additional 16 hours or a total of 18 hours and picking once more.
12. When picking the granules, especially on the wet test, the asphalt may have a tendency to crack or break around the granule. When this occurred, the cracked or broken granule was discarded and additional granules were picked for evaluation.

4. The Adhesive Screening Test

To screen adhesives for their ability to enhance the granule bond to the coating asphalt, a test procedure was utilized which involves combining the preparation of stain panels followed by conducting wet and dry rub tests as outlined above.

An asphalt-fiberglass spread was used to prepare the stain panel. The asphalt-fiberglass spread was a fiberglass substrate with coating asphalt spread over its surface. A 4-inch by 12-inch stain panel was cut from the asphalt-fiberglass spread. The panel preparation oven, which was a conventional Despatch oven, was set at 370° F. (188° C.) with the oven trays installed so that they would be pre-heated. The trays remain in the oven when not in use. A stain panel was then placed on one of the oven trays and the oven heat was set at 360° F.–365° F. (182° C.–185° C.) for approximately 4½ minutes. The asphalt of the sample was sufficiently heated so that it would just run off the fiberglass spread and would have a glossy, shiny, look. Heat time may need to be adjusted depending upon the coating asphalt being used.

The heated panel was then removed from the oven and quickly transferred to a stainless steel tray with a long spatula. The adhesive to be screened was then sprayed on the heated panel. Immediately, in no more than 8 seconds, a quantity of granules sufficient to cover the stain panel, was applied from a height of approximately 9 inches. The tray holding the stain panel was then tipped to shake off excess granules.

The granules remaining on the stain panel were then embedded into the asphalt with the bottom of a 250 ml. Erlenmeyer flask. This is done by a technique of rubbing lightly, using quick, smooth strokes, back and forth across the panel. With experience, one can apply sufficient pressure to embed the granules, but not dig into the soft asphalt.

Immediately a second quantity of granules was applied to sufficiently cover the panel. Loose granules from this application were shaken off and the embedding process was repeated. The second coating generally filled any empty spaces left after the first coating. The sample was then allowed to cool to room temperature.

Wet rub tests and dry rub tests were then conducted on these samples as outlined above with the results compared to control samples prepared with a duplicate procedure, however, lacking the addition of any adhesive.

EXAMPLE 1: PICK TEST EXPERIMENT

3M Hot-Melt Adhesive, Jet Melt #3762-AE was applied to the surface of the hot asphalt (365° F. or 185° C.) in a Pick Test Experiment by the procedure described above. The adhesive was applied immediately before the granules were applied and pressed into the surface of the coating asphalt and allowed to cool to room temperature. Application of this adhesive was achieved with a conventional manual piston gun applicator, followed by manually spreading the adhesive with a spatula or similar implement. The adhesion of the granules to the asphalt and hot-melt adhesive was measured using the above pick test procedure. It was observed that the granules pulled off of untreated (i.e. no adhesive) asphalt substrates following this procedure retained asphalt fragments over 46% of the prior granule-asphalt interface. In contrast, 100% of the prior granule-substrate interface retained substrate fragments for granules pulled from the adhesive treated asphalt substrates according to the present invention.

EXAMPLE 2: ADHESIVE SCREENING EXPERIMENTS

Several adhesives were screened for their ability to improve the adhesive bond of the roofing granules or mineral material to the finished roofing product. In all experiments, the above-outlined procedure for preparing the stain panels followed by the outlined wet rub test and dry rub test were followed. Samples which included an adhesive material were coated in a random pattern with the adhesive by utilizing a blown-fiber spray gun manufactured by PAM Fastening Technology, Inc. of Charlotte, N.C., Model PAM 500KS with the operating conditions as outlined below.

A control sample or stain test sample was made without adhesive (asphalt only) at an oven temperature of 365° F. (185° C.) for 4½ minutes following the screening procedure outlined above. Test samples utilizing several adhesives were made under the following conditions utilizing the PAM spray gun:

Sample 1: 3M hot-melt adhesive #3755, an ethylene-vinyl acetate resin blend was applied in a random pattern utilizing the PAM spray gun with the spray regulator set at 0.5 and an air pressure of 70 p.s.i.g. The hot-melt adhesive temperature was approximately 300° F.–350° F. (149° C.–177° C.). This adhesive was applied to the stain panel after it had been heated for 4½ minutes at 365° F. (185° C.) in an oven.

Sample 2: 3M hot-melt adhesive #3777, an ethylene-methyl-acrylate resin blend, was applied in a random pattern utilizing the PAM spray gun with a regulator setting of 2.0 and an air pressure of 80 p.s.i.g. while the hot-melt adhesive temperature ranged from 400° F.–410° F. (204° C.–210° C.). This was applied to the stain panel after it had been placed in an oven at 365° F. (185° C.) for 4½ minutes.

Sample 3: An ethylene-n-butylacrylate resin blend (ENBA) was applied utilizing the PAM spray gun with a regulator setting of 2.0 and air pressure of 80 p.s.i.g. while the hot-melt adhesive temperature was held at 350° F.–355° F. (177° C.–180° C.). This was applied in a random pattern to a stain test panel after it had been placed in an oven at 365° F. (185° C.) for 4½ minutes. The ENBA adhesive is disclosed in detail in co-pending U.S. patent application Ser. No. 07/809,005, filed Dec. 17, 1991 and incorporated herein by reference.

Sample 4: 3M hot-melt adhesive #3756, an ethylene-vinyl acetate resin blend, was applied to a stain panel subsequent to it being held in an oven at 365° F. (185° C.) for 4 ½ minutes. The hot-melt adhesive was applied at a temperature of 375° F. (191° C.) using the PAM spray gun and the spray regulator setting of 2.0 and an air pressure of 80 p.s.i.g.

Dry rub tests and wet rub tests at 1-day were conducted on all of the samples described above, including the no-adhesive control sample. The results are tabulated in Table 1 below. It is clear 3M #3755 provided superior wet rub adhesion and is a preferred adhesive for applications of the present invention.

TABLE 1

| Adhesive Screening Tests | | |
|---|---|---|
| Adhesive | Dry Rub Loss*(g) | 1-Day Wet Rub Loss*(g) |
| No Adhesive | 0.44 | 7.73 |
| 3M #3755 | 0.13 | 0.02 |
| 3M #3777 | 0.10 | 0.29 |
| ENBA | 0.02 | 0.18 |
| 3M #3756 | 0.11 | 0.62 |

*Lose of granules, in grams, from the test sample. Each sample had about 80 to 100 grams of granules thereon.

EXAMPLE 3: WET AND DRY RUB TEST EXPERIMENT ON PILOT PLANT ROOFING PRODUCTS

Asphalt roofing materials were manufactured in a pilot plant facility to test the improvements in dry rub and wet rub loss on actual roofing material utilizing the same adhesives as disclosed in Example 2 above. Adhesive was applied with the same method and under the same conditions as detailed in Example 2. The substrate material onto which the adhesive was placed included a fiberglass matting onto which asphalt was deposited in an even layer at a temperature of about 365° F. (185° C.). A control sample for comparison was manufactured utilizing no adhesive. A pre-set doctor blade was used to make certain each sample, for comparative purposes, had an even distribution of asphalt of equal thickness on all samples. Dry rub tests and a 7-day wet rub test were conducted on the samples utilizing the procedures described above. The results are tabulated in Table 2 below. It is again clear that 3M #3755 provided superior adhesion in the wet rub test after 7 days and is a preferred adhesive for applications of the present invention.

TABLE 2

| Adhesive Tests on Actual Asphalt Roofing Products | | |
|---|---|---|
| Adhesive | Dry Rub Loss*(g) | 7-Day Wet Rub Loss*(g) |
| No Adhesive | 0.60 | 4.06 |
| 3M #3755 | 0.15 | 0.68 |
| 3M #3777 | 0.08 | 0.94 |
| ENBA | 0.11 | 0.90 |
| 3M #3756 | 0.32 | 1.04 |

*Loss of granules, in grams, from the test sample. Each sample had about 80 to 100 grams of granules thereon.

What is claimed is:

1. A roofing product comprising:

(a) coating asphalt;

(b) a plurality of roofing granules embedded in the coating asphalt; and (c) a non-asphalt, thermoplastic water-resistant adhesive applied onto a surface of the coating asphalt and covering at least a portion of said surface of the coating asphalt so as to provide an interface between the roofing granules and the coating asphalt.

2. A roofing product according to claim 1 including:

(a) a cellulose fiber substrate having said coating asphalt positioned thereon.

3. A roofing product according to claim 1 including:

(a) a fiberglass mat substrate having said coating asphalt positioned thereon.

4. A roofing product according to claim 1 wherein said roofing granules are selected from the group consisting of: coated mineral aggregate; uncoated mineral aggregate; coated ceramic granules; uncoated ceramic granules; and mixtures thereof.

5. A roofing product according to claim 4 wherein said non-asphalt, thermoplastic water-resistant adhesive has a sufficiently low viscosity to facilitate spraying at a temperature in the range between 150° C. and 260° C.

6. A roofing product according to claim 4 wherein said non-asphalt, thermoplastic water-resistant adhesive comprises a blend of thermoplastic polymers and tackifying resins which as a blend are water-resistant.

7. A roofing product according to claim 2 wherein said non-asphalt, thermoplastic water-resistant adhesive has a viscosity sufficiently low to facilitate spraying at a temperature in the range between 150° C. and 260° C.

8. A roofing product according to claim 2 wherein said non-asphalt, thermoplastic water-resistant adhesive comprises hot melt adhesive material selected from the group consisting of blends of thermoplastic polymers and tackifying resins.

* * * * *

UNITED STATES PATENT AND TRADEMARK OFFICE

CERTIFICATE OF CORRECTION

PATENT NO. : 5,516,573

DATED : May 14, 1996

INVENTOR(S) : Billy L. George et al.

It is certified that error appears in the above-identified patent and that said Letters Patent is hereby corrected as shown below:

On the title page, item [54] and column 1, lines 1-4, the title should read -- Roofing Materials Having a Thermoplastic Adhesive Interface Between Coating Asphalt and Roofing Granules --.

Col. 13, line 30, Footnote to Table 1, "lose of granules" should read -- loss of granules --.

Signed and Sealed this

Seventeenth Day of March, 1998

*Attest:*

*Attesting Officer*

BRUCE LEHMAN

*Commissioner of Patents and Trademarks*